US005926095A

United States Patent [19]

Ho et al.

[11] Patent Number: 5,926,095

[45] Date of Patent: Jul. 20, 1999

[54] TRANSVERSE FIELD ANNEALING PROCESS TO FORM E.A.S. MARKER HAVING A STEP CHANGE IN MAGNETIC FLUX

[75] Inventors: Wing K. Ho, Boynton Beach, Fla.; Jiro Yamasaki, Fukuoka, Japan; Richard Tellshow, Boynton Beach, Fla.

[73] Assignee: Sensormatic Electronics Corporation, Boca Raton, Fla.

[21] Appl. No.: 09/044,045

[22] Filed: Mar. 18, 1998

[51] Int. Cl.[6] ..... G08B 13/14

[52] U.S. Cl. ..... 340/572.6; 340/572.1; 340/572.2; 340/551

[58] Field of Search ..... 340/572.1, 572.2, 340/572.6, 572.3, 572.4, 551, 825.56

[56] References Cited

U.S. PATENT DOCUMENTS

| | | | |
|---|---|---|---|
| 4,660,025 | 4/1987 | Humphrey | 340/572.2 |
| 4,980,670 | 12/1990 | Humphrey et al. | 340/551 |
| 5,083,112 | 1/1992 | Piotrowski et al. | 340/551 |
| 5,121,106 | 6/1992 | Kataria et al. | 340/551 |
| 5,313,192 | 5/1994 | Ho et al. | 340/551 |
| 5,554,974 | 9/1996 | Brady et al. | 340/551 |
| 5,565,849 | 10/1996 | Ho et al. | 340/572.6 |
| 5,602,527 | 2/1997 | Suenaga | 340/551 |
| 5,605,768 | 2/1997 | Furukawa et al. | 340/551 |
| 5,790,030 | 8/1998 | Lievens et al. | 340/572.6 |

OTHER PUBLICATIONS

"Anisotropy Pinning of Domain Walls in a Soft Amorphous Magnetic Material", Rudolf Schafter, et al., *IEEE Transactions on Magnetics*, vol. 27, No. 4, pp. 3678–3684, Jul., 1991.

*Primary Examiner*—Jeffery A. Hofsass
*Assistant Examiner*—Benjamin C. Lee
*Attorney, Agent, or Firm*—Robin, Blecker & Daley

[57] ABSTRACT

A marker to be used in an article surveillance system is formed by processing a continuous ribbon of magnetic material having a longitudinal axis. Domains are developed in the magnetic material to produce a wall configuration which includes a plurality of substantially parallel domain walls extending in a wall direction that is canted at least 15° from the longitudinal axis of the continuous ribbon. The continuous ribbon is then further processed to cause the wall configuration of substantially parallel domain walls to remain in a pinned state for values of applied field below a threshold value. The processed continuous ribbon can be cut to produce discrete magnetic elements which exhibit a step change in magnetic flux when the applied field crosses a threshold value.

62 Claims, 6 Drawing Sheets

TRANSVERSE FIELD ANNEALING PROCESS TO FORM E.A.S. MARKER HAVING A STEP CHANGE IN MAGNETIC FLUX

FIELD OF THE INVENTION

This invention relates to magnetic materials for use as sensors, and to methods and systems for making and using such markers.

BACKGROUND OF THE INVENTION

In the design of electronic article surveillance (EAS) systems which use magnetic type markers, efforts have been made to enhance the uniqueness of the marker's response. One way that this has been accomplished is by increasing the high harmonic content in the voltage pulse generated by the magnetic flux reversal of the marker. As a result, the marker's response signal becomes more easily differentiated and detectable over the lower frequency background noise and magnetic shield noise and signals generated by other magnetic materials often found to exist in EAS systems.

A magnetic marker which exhibits a high degree of uniqueness is disclosed in U.S. Pat. No. 4,660,025, entitled "Article Surveillance Magnetic Marker Having An Hysteresis Loop With Large Barkhausen Discontinuities," which is commonly assigned with the present application. In an embodiment of the invention disclosed in the '025 patent, a marker is formed of an amorphous metal alloy ribbon having locked-in stresses which give rise to large Barkhausen discontinuities in its hysteresis loop. The discontinuities in the hysteresis loop occur at a switching threshold. When the marker is exposed to an alternating interrogation field signal with a peak amplitude that exceeds the switching threshold, high harmonics of the interrogation field signal are generated.

Another magnetic marker which generates high harmonics of an interrogation field signal is disclosed in U.S. Pat. No. 4,980,670, entitled "Deactivatable E.A.S. Marker Having a Step Change In Magnetic Flux." The '670 patent has a common inventor and a common assignee with the present application. The hysteresis characteristic of the marker of the '670 patent exhibits step changes in flux at threshold values of the applied field. In the case of the '670 patent, the desired hysteresis characteristic is brought about by conditioning the material of the marker so that it has a pinned domain wall configuration that remains pinned until the applied field reaches a predetermined threshold value, at which the pinned condition is overcome by the applied field, causing a step change in flux. The step change in flux provides a response signal from the marker which is rich in high harmonic content and is therefore unique and easily detectable.

According to a process disclosed in the '670 patent, a continuous ribbon of amorphous magnetic alloy is cut to form discrete strips of the magnetic alloy material. A magnetic field is applied in the longitudinal direction of the cut strips to form a domain structure, and the resulting domain walls are pinned by annealing. A similar wall-pinning process is described in "Anisotropy Pinning of Domain Walls in a Soft Amorphous Magnetic Material", Schafer et al., *IEEE Transactions on Magnetics*, Vol. 27, No. 4, July 1991, pp. 3678–3689.

An improved process for making magnetic markers having a step change in magnetic flux is disclosed in U.S. Pat. No. 5,313,192 which is entitled "Deactivatable/Reactivatable Magnetic Marker Having A Step Change In Magnetic Flux", and which has common inventors and a common assignee with the present application.

According to teachings of the '192 patent, it is possible to avoid cumbersome and labor-intensive handling of the cut strips by applying wall pinning processing to a continuous strip of amorphous metal alloy. Regions of the continuous amorphous material are crystallized throughout the bulk of the material at regular intervals along the length of the continuous ribbon. The crystallized bulk regions magnetically isolate the amorphous, pinned-wall intervening regions so that cutting in the crystallized regions to separate the continuous ribbon into individual marker strips does not significantly alter the pinned-wall magnetic properties of the resulting individual markers.

The disclosure of the '025, '670 and '192 patents is incorporated herein by reference.

Although the above-described continuous annealing process of the '192 patent is advantageous in that it permits efficient fabrication of individual markers exhibiting a pinned wall hysteresis characteristic, the crystallized regions provided at regular intervals to magnetically isolate the marker from the adverse effect of cutting the continuous ribbon are somewhat disadvantageous, in that the presence of the crystallized regions at regular intervals predetermine the length of the marker segments. Once the continuous ribbon has been formed with the crystallized regions thereon, the length of the markers to be produced therefrom is fixed. It would be desirable to produce rolls of continuous pinned-wall material from which discrete marker strips of any desired length may be cut.

OBJECTS AND SUMMARY OF THE INVENTION

It is an object of the invention to produce magnetic components having a pinned-wall characteristic by means of a continuous annealing process.

It is a further object of the invention to produce such magnetic components having a length that is not predetermined by locations of crystallized regions formed in a continuous metal alloy strip.

According to an aspect of the invention, there is provided a method of making a marker which is used in an article surveillance system, the method including the steps of providing a continuous ribbon of magnetic material having a longitudinal axis, developing in the continuous ribbon of magnetic material domains having a wall configuration including a plurality of substantially parallel domain walls, the plurality of substantially parallel domain walls extending in a wall direction that is canted at least 15° from the longitudinal axis of the continuous ribbon, and after the developing step, processing the continuous ribbon to cause the wall configuration of the substantially parallel domain walls to remain in a pinned state for values of applied field below a threshold value. The processing steps required to obtain the pinned state of the wall configuration may include annealing, or alternatively may be carried out by depositing a layer of hard or semi-hard magnetic material, in accordance with teachings of co-pending application serial no. [attorney docket no. C4-466], which is filed simultaneously with this application, and has a common inventor and a common assignee with this application.

Preferably the magnetic material exhibits substantially zero magnetostriction, and after processing in accordance with this aspect of the invention, the threshold value is less than 1 Oe. According to alternative preferred embodiments of the invention, the parallel domain walls may be formed at 90° or 45° from the longitudinal axis of the continuous ribbon of magnetic material.

According to another aspect of the invention, there is provided a method of making a marker which is to be used in an article surveillance system, the method including the steps of providing a continuous ribbon of magnetic material having a longitudinal axis, developing in the continuous ribbon of magnetic material domains having a wall configuration including a plurality of substantially parallel domain walls, the plurality of substantially parallel domain walls extending in a wall direction that is canted at least 15° from the longitudinal axis of the continuous ribbon, and after the developing step, processing the continuous ribbon to stabilize the wall configuration of the substantially parallel domain walls, then, after the processing step, cutting the continuous ribbon in a direction transverse to the longitudinal axis of the continuous ribbon to form discrete marker elements, the discrete marker elements each having a magnetic hysteresis loop with a large Barkhausen discontinuity such that exposing the marker element to an external magnetic field, whose field strength in the direction opposing the magnetic polarization of the marker element exceeds a predetermined threshold value, results in regenerative reversal of the magnetic polarization.

With the domain wall pinning or stabilizing processes of the present invention, the processed continuous alloy ribbon can be cut transversely to produce discrete strips of any desired length while preserving the desired step-flux characteristic. Domains at the ends of the strip serve to magnetically isolate the domains which do not touch the ends of the strip from the disruptive effect of the cutting operation.

The above and other features and aspects of the present invention will become more apparent upon reading the following detailed description in conjunction with the accompanying drawings.

DETAILED DESCRIPTION OF PREFERRED EMBODIMENTS AND PRACTICES

Figure 1:
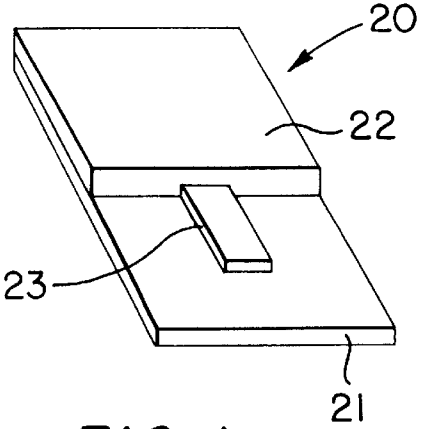
FIG. 1 shows an article surveillance marker incorporating a magnetic element produced in accordance with the principles of the present invention.

In FIG. 1, a marker 20 in accordance with the principles of the present invention is shown. The marker 20 includes a substrate 21 and an overlayer 22 between which is disposed a magnetic element 23. The under surface of the substrate 21 can be coated with a suitable pressure-sensitive adhesive for securing the marker 20 to an article to be maintained under surveillance. Alternatively, any other known arrangement can be employed to secure the marker 20 to the article.

Figure 2:
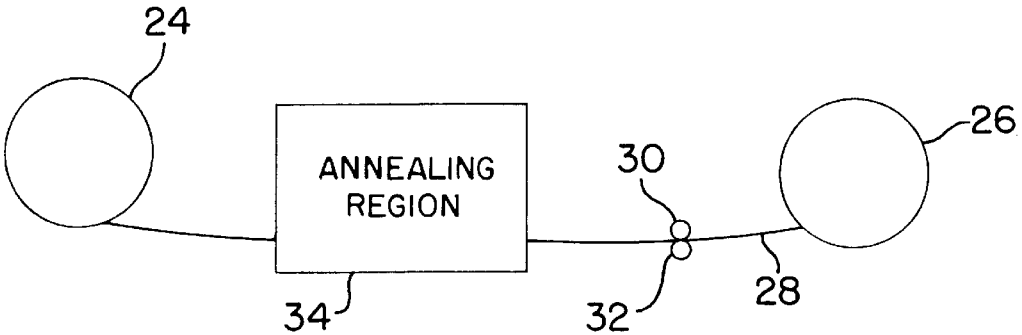
FIG. 2 schematically illustrates an apparatus used to carry out processes in accordance with the present invention.

FIG. 2 schematically illustrates an apparatus employed for continuous processing of a magnetic material in accordance with the invention. Reference numeral 24 indicates a supply reel and reference number 26 indicates a take up reel. A continuous ribbon 28 of a magnetic metal alloy is continuously withdrawn from the supply reel 24 and taken up on the take up reel 26. The continuous metal alloy ribbon 28 is engaged between a capstan 30 and a pinch roller 32. The capstan 30 and pinch roller 32 cooperate to continuously transport the metal ribbon 28 along a path from the supply reel 24 to the take up reel 26. On the path between the reels 24 and 26 is disposed an annealing region 34 through which the metal ribbon 28 is continuously transported. The annealing region 34 may be provided by an oven in which one or more configurations of magnetic field may be generated.

EXAMPLE 1

Figure 3:
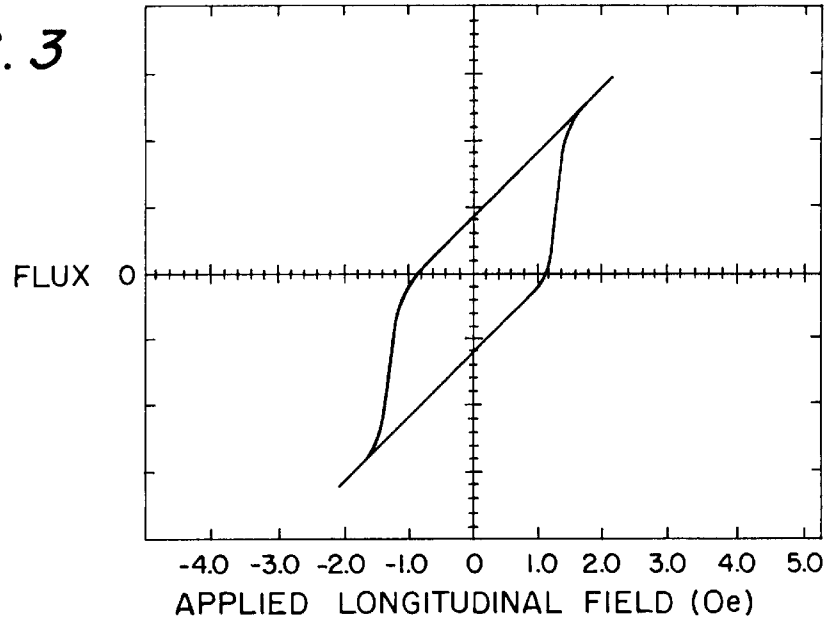
FIG. 3 shows a hysteresis loop characteristic of a marker produced in accordance with a first embodiment of the invention.

According to this example, a two-stage annealing process that can be performed using the apparatus of FIG. 2 was applied to a discrete strip of an amorphous material having the composition $Co_{74}Fe_5Si_2B_{19}$ (by atomic percent), and dimensions 50 mm×7 mm×0.019 mm. It will be appreciated that this material exhibits substantially zero magnetostriction. In the first annealing stage a transverse magnetic field was applied, with a magnitude of at least 200 Oe. The field was applied in the plane of the ribbon and substantially perpendicular to the longitudinal axis of the ribbon. The first annealing stage was performed at a temperature of 300° C. and for period of 20 minutes. Then, the second annealing was performed to pin or stabilize the transverse domain configuration developed during the first annealing. In the second annealing stage, a temperature of 350° C. was maintained for an effective period of 20 minutes, and no magnetic field was applied although a small stray field was present. After this process, magnetic element had a hysteresis loop characteristic as illustrated in FIG. 3. It will be seen that the characteristic of FIG. 3 exhibits a large Barkhausen discontinuity or step change in magnetic flux at a threshold level of about 1.2 Oe.

Figure 5:
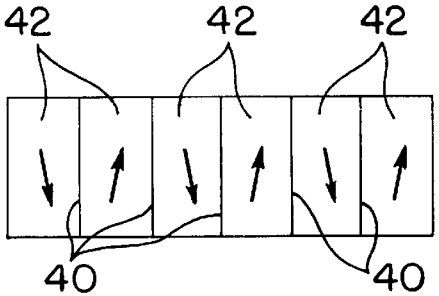
FIG. 5 is a pictorial illustration of a magnetic element having transversely-extending domains in a "zig-zag" configuration produced in accordance with the first embodiment of the invention.

FIG. 5 pictorially illustrates the domain configuration developed in the magnetic element in accordance with this example. A sequence of parallel domain walls 40 is formed along the length of the alloy strip. The domain walls 40 define a sequence of domains 42 along the length of the strip. The domain walls 40 extend in a direction substantially perpendicular to the longitudinal axis of the strip.

Because of the stray field present during the second annealing stage, the magnetic element has a small remanent magnetization along its length, and the magnetic polarities of the domains 42 exhibit a "zig-zag" pattern as indicated in FIG. 5. That is, each of the domains 42 exhibits one of two orientations, and the domain orientations alternate along the length of the magnetic element. The orientations of the magnetic polarities are represented by the arrows in FIG. 5. One of the two orientations is upward and to the right. The other is downward and to the right. (It should be understood that the degree of right-ward tilt of the arrows is somewhat exaggerated in FIG. 5 for purposes of illustration.) For purposes of the ensuing discussion, the right-ward direction in FIG. 5 corresponds to the positive directions of the axes in FIG. 3.

Figure 6:
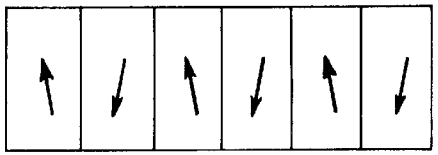
FIG. 6 is a pictorial illustration of an opposite polarity "zig-zag" domain configuration exhibited by the magnetic element of FIG. 4 in response to a longitudinally-applied interrogation field signal.

There will now be described, with reference to FIGS. 5 and 6, a mechanism which the applicants believe causes the step change in flux exhibited by the hysteresis loop of FIG. 3.

Assuming that the applied field is reduced from a positive value above the threshold level, the flux decreases as the longitudinal applied field is reduced to zero, and this is believed to be accompanied by rotation of the domain polarizations in a leftward direction. The reduction in flux continues to a substantially zero resultant flux, for a level of applied field close to the negative threshold level. Then, at the negative threshold, there is an abrupt reversal in the domain polarities to provide the alternative zig-zag pattern shown in FIG. 6, in which the domain polarities are either pointing upwards and to the left or downwards to the left. It will be noted that each domain polarity in FIG. 6 is diametrically opposite to the polarity of the corresponding domain in FIG. 5. The abrupt reversal of the domain polarity is a "snap action" which provides the discontinuous or step flux change shown at the −1.2 Oe level in FIG. 3. It is also possible that there is a release of domain wall pinning at this level.

The mechanism then reverses as the negative (left-ward) applied field is reduced below the threshold level and then increased in the positive direction to a level above the positive threshold. At the positive threshold another discontinuous change in flux occurs.

EXAMPLE 2

The same material as in Example 1 was processed in the same manner, except that a 2 Oe magnetic field was applied in the longitudinal direction of the strip during the second annealing stage.

Figure 7:
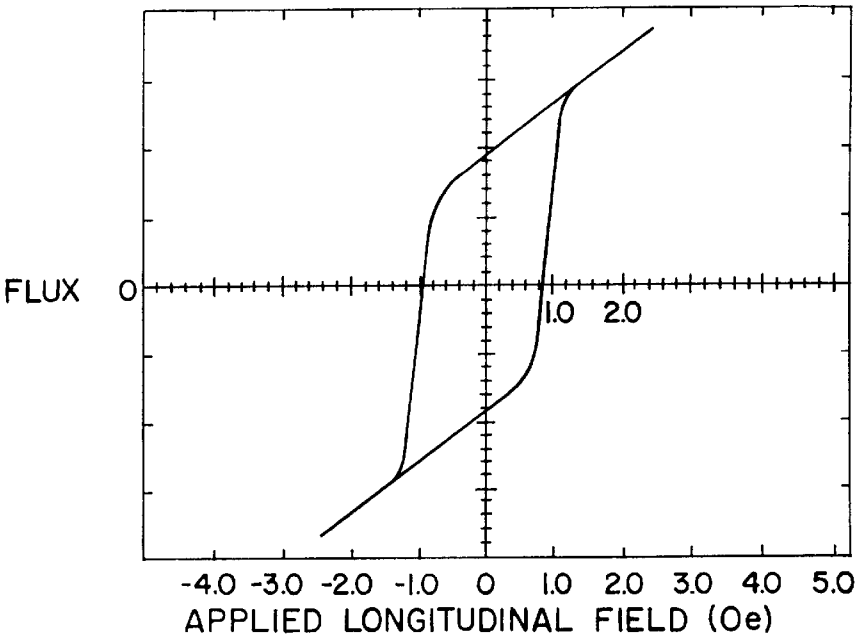
FIG. 7 shows a hysteresis loop characteristic of a magnetic element formed in accordance with a second embodiment of the invention.

FIG. 7 shows the hysteresis loop characteristic for the resulting magnetic element. It will be observed from FIG. 7 that a large discontinuity, or step change in magnetic flux occurs at a threshold level of about 0.9 Oe. The step shown in FIG. 7 is larger than that of the characteristic produced in the previous example. The greater amplitude of the flux step in this example results from the greater longitudinal magnetization produced in the second annealing stage.

The results obtained in this example may be considered more favorable than those in the previous example, since a lower threshold level and a larger step change in flux are both desirable characteristics. However, if the longitudinal field in the second anneal is increased to 3 or 4 Oe., the longitudinal component of the magnetization becomes large enough to provide a substantial demagnetizing field. The resulting magnetic element exhibits a shear loop characteristic rather than a flux step characteristic.

EXAMPLE 3

Figure 8A:
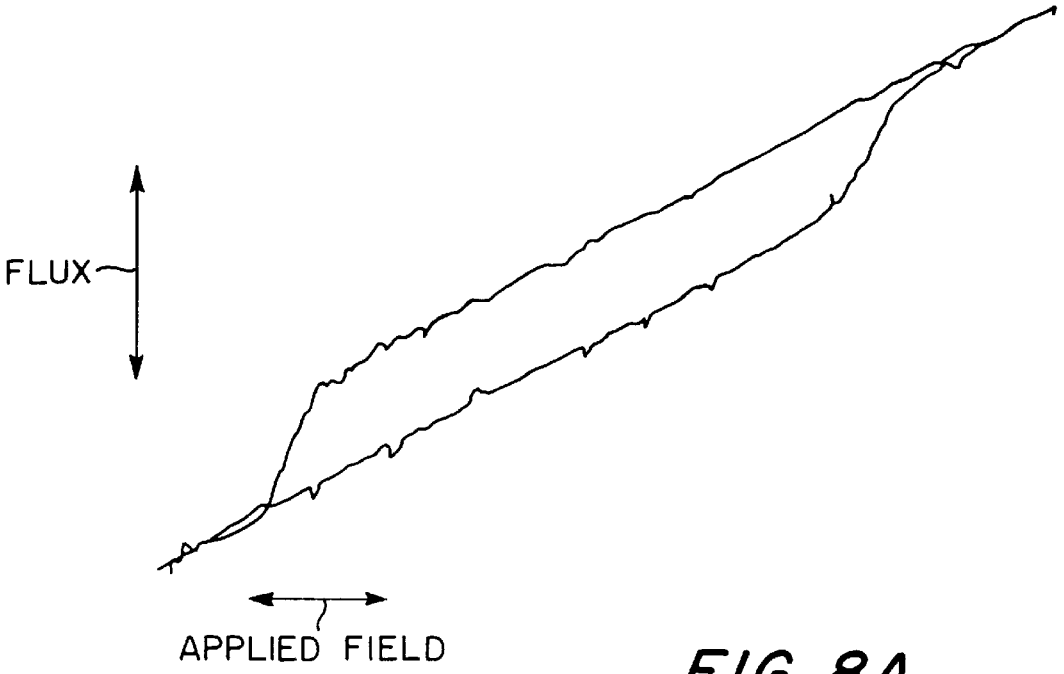
FIG. 8A shows a hysteresis loop characteristic of another example of a magnetic element formed in accordance with the invention.

An amorphous metal alloy strip having the same composition and the same length extent as in the previous examples, but a width of 3.2 mm and a thickness of 0.02 mm, was used in this example. In the two-stage annealing process, the first annealing stage was carried out for 20 minutes at 300° C. and with a field of 1 kOe applied perpendicular to the longitudinal axis of the material in the plane of the material. The second annealing stage was carried out for 30 minutes at 350° C. with a small magnetic field (substantially less than 1 Oe) applied along the longitudinal axis of the material. The hysteresis loop of the resulting material is shown in FIG. 8A. The presence of step changes in flux will be noted.

Figure 8B:
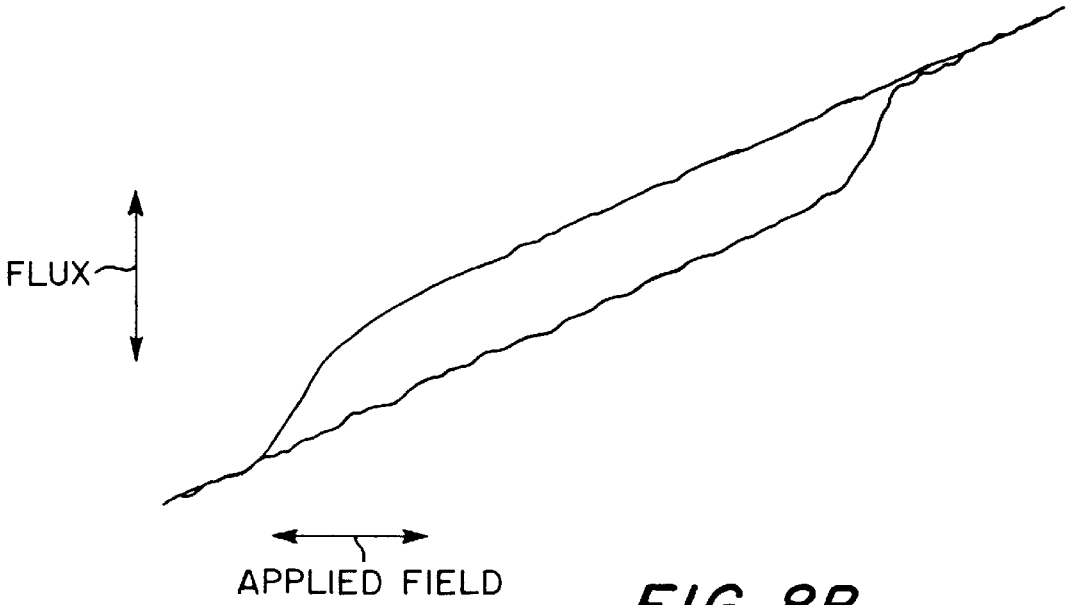
FIG. 8B shows a hysteresis loop characteristic of a magnetic element obtained by trimming the ends of the magnetic element of FIG. 8A.

About 3 mm of the material was then trimmed from each end of the magnetic element. The hysteresis loop of the trimmed magnetic element is shown in FIG. 8B, and is essentially identical to the hysteresis loop of the element before trimming. This serves to demonstrate that the magnetic characteristics of the element were not adversely affected by cutting across the width of the element. It is believed that the presence of transversely extending domain walls in the magnetic element served to isolate most of the domains in the element from any demagnetizing effects of the cutting operation.

EXAMPLE 4

Figure 9:
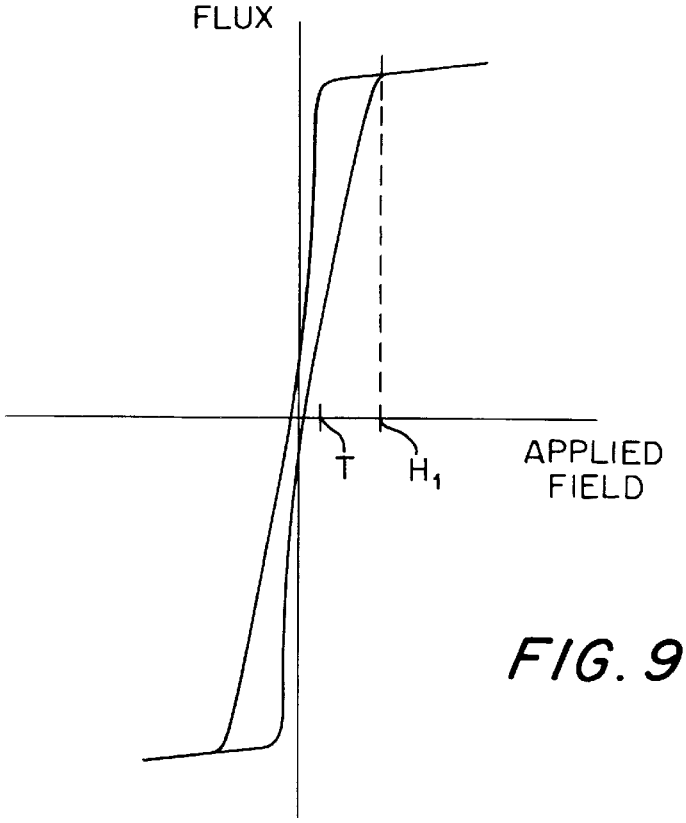
FIG. 9 shows a hysteresis loop characteristic of another example of a magnetic element formed in accordance with the invention.

An element having the same composition and dimensions as in Example 3 was used in this example. The first annealing stage was carried out for 30 minutes at 300° C. with a perpendicular field of over 1 kOe. The second annealing stage was carried out for 10 minutes at 350° C. with a longitudinal applied field of 1 Oe. The hysteresis loop characteristic for the resulting material, obtained in response to a drive field that alternates with a peak amplitude of 2 Oe in the longitudinal direction, is shown in FIG. 9. It will be observed that the characteristic is partly discontinuous and partly shear. It is believed that the more shear characteristic shown in FIG. 9, as compared to the characteristic of FIG. 8, is due to increased longitudinal magnetization resulting from the larger longitudinal field applied during the second annealing stage.

The hysteresis loop characteristic of FIG. 9 is somewhat different from the characteristic shown FIG. 7, which exhibits a step reversal in magnetic polarity at the so-called "switching threshold" (about 0.8 Oe in the case of FIG. 7). The characteristic of FIG. 9 also differs from the loop characteristic shown in FIG. 3 of the '670 patent, in which a step increase in magnetization occurs at the pinning threshold +Hp. By contrast, the characteristic of FIG. 9 herein exhibits a step decrease at a threshold point indicated at T in FIG. 9 upon a suitable reduction in applied field. That is, if the applied field is at a level $H_1$, substantially above the threshold level T, and then the amplitude of the applied field is reduced, a discontinuous reduction in the degree of magnetization of the magnetic element occurs when the threshold level T is reached. In this case it is believed that the demagnetization effect of the geometry of the element combines with the reduction in applied field to cause a discontinuous drop in magnetization at the threshold. The level of the threshold point T in this example is well below 1 Oe.

Figure 10A:
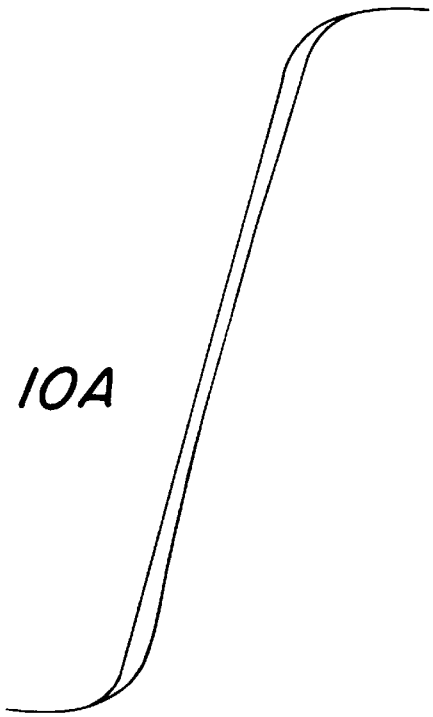
FIG. 10A shows a hysteresis loop characteristic of a magnetic element obtained by trimming the ends of the magnetic element of FIG. 9.
Figure 10B:
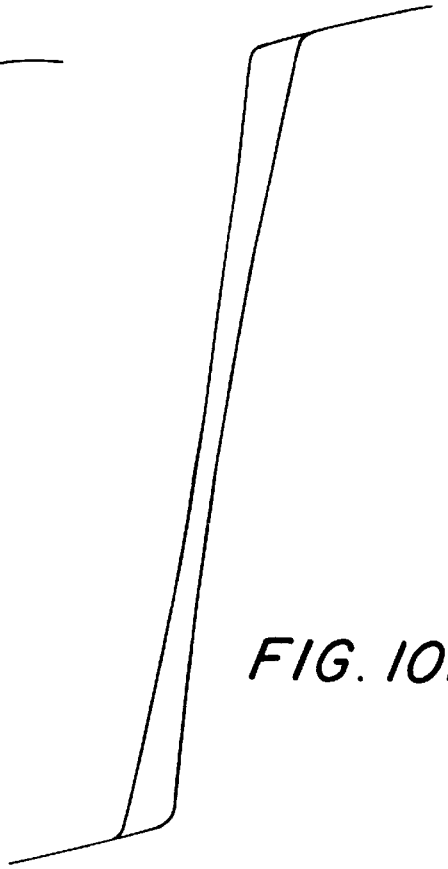
FIG. 10B shows a hysteresis loop characteristic obtained by placing flux concentrators at the ends of the magnetic element of FIG. 10A.

FIG. 10A shows the hysteresis loop characteristic obtained when 3 mm of material were trimmed from each end of the element. It will be seen that cutting the element produced in this example essentially eliminates the discontinuity in the hysteresis loop characteristic. However, the discontinuity can be recovered by providing flux concentrators at each end of the magnetic element. When a flux concentrator formed of iron-based amorphous ribbon and having dimensions 10 mm×7 mm×0.02 mm was placed at each end of the magnetic element with the end of the material at the center of the respective flux concentrator, the hysteresis loop shown in FIG. 10B resulted. It will be observed that the loop of FIG. 10B is substantially the same as that of FIG. 9.

EXAMPLE 5

Figure 11:
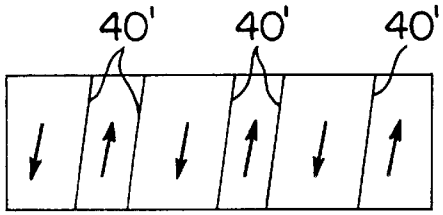
FIG. 11 is a pictorial illustration of an "uneven barber pole" domain configuration formed in a magnetic element provided according to a third embodiment of the invention.

In this example, the procedure described in Example 2 above was changed in that, during the first annealing stage, the magnetic field was applied at an angle that was a few degrees (not more than 10°) away from perpendicular to the longitudinal axis of the material. The small longitudinal field applied during the second annealing stage resulted in a non-zero remanence. Again, a discontinuity in the hysteresis loop characteristic was produced. The domain configuration resulting from the off-perpendicular annealing is pictorially illustrated in FIG. 11. The configuration of FIG. 11 may be referred to as an "uneven barber pole" configuration. It will be observed that the domain walls 40' in FIG. 11 extend in parallel, and at an acute angle relative to, the longitudinal axis of the material. The width of the domains in the direction of the longitudinal axis of the material varies, in that relatively wide domains having a polarity directed downward and in one longitudinal direction alternate with relatively narrow domains having a polarity oriented upwardly and in the opposite longitudinal direction of the magnetic element. The orientations of the domain polarities are parallel to the domain wall orientation.

If a magnetic field is applied in the rightward longitudinal direction of the magnetic element, the domains tend to rotate in the direction of the applied field until a threshold level is reached, at which point the larger domains undergo an abrupt reversal in orientation. At the same time, the smaller domains also reverse to minimize the magnetostatic energy. The result is a large discontinuity in the hysteresis loop.

EXAMPLE 6

In this example, an element having the same composition as in the previous examples, and having dimensions 50 mm×3 mm×0.02 mm, was subjected to a two-stage annealing process to produce a pinned wall domain configuration. The first annealing stage was performed for 20 minutes at 300° C. and with a saturating magnetic field oriented at 45° from the longitudinal axis of the material and in the plane of the material. The second annealing stage was carried out for 20 minutes at 350° C. with no field or only a very small field present.

Figure 13:
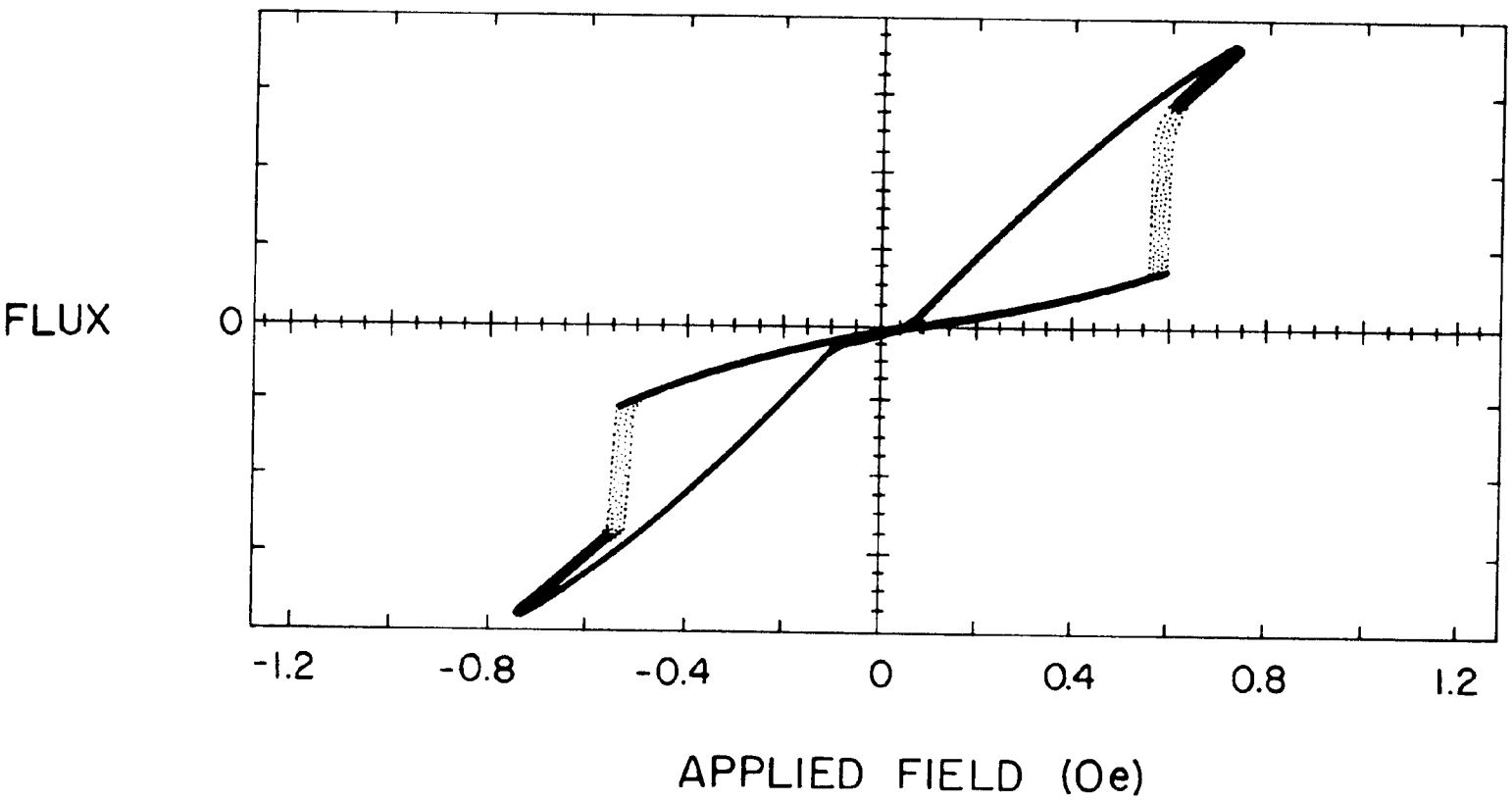
FIG. 13 shows a hysteresis loop characteristic of the magnetic element of FIGS. 12A and 12B.

The hysteresis loop of the resulting magnetic element is shown in FIG. 13. It should be noted that this characteristic is similar to that shown in FIG. 3 of the above-referenced '670 patent. It will be observed from the hysteresis characteristic that a switching threshold level occurs at approximately 0.6 Oe.

Figure 12B:
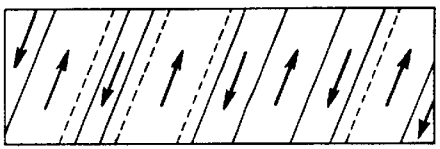
FIG. 12B pictorially illustrates an "Uneven barber pole" configuration which results from the release of pinned walls in the configuration of FIG. 12A upon exposure to an interrogation field signal.
Figure 12A:
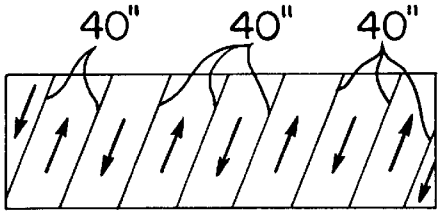
FIG. 12A is a pictorial illustration of an "even barber pole" domain configuration formed in a magnetic element in accordance with a fourth embodiment of the invention.

The domain configuration which results from the two-stage annealing process of this Example is pictorially illustrated in FIG. 12A. This domain configuration may be referred to as an even "barber pole" configuration in that the domain walls are parallel and oriented at an acute angle relative to the longitudinal axis of the magnetic element, and the widths of the domains in the direction of the longitudinal axis are substantially uniform. The orientation of polarity of the domains alternates along the length of the magnetic element between an orientation that is upward and to the right and an orientation that is downward and to the left. The orientations of the domain polarities are parallel to the domain wall orientation.

FIG. 12B pictorially illustrates how domain walls are released or "depinned" in response to a magnetic field applied along the length of the magnetic element at a level above the threshold level. For the purposes of FIG. 12B, it is assumed that the field is applied in the rightward direction. The dotted lines in FIG. 12B are the former sites of domain walls that were originally pinned in the domain configuration of FIG. 12A. As seen from FIG. 12B, domain walls have shifted to permit domains which have an orientation in the upward-rightward direction to grow at the expense of domains having a polarization in the downward-leftward direction. The resulting configuration induced by the rightward applied field is an uneven barber pole configuration. The release of the formerly pinned walls occurs abruptly, which produces the discontinuous or stepped loop characteristic of FIG. 13.

As in the preceding examples, most of the domains extend transversely across the magnetic element and do not touch the ends of the element. Therefore, cutting at the ends of the element does not affect most of the domains, which allows the desired discontinuous hysteresis loop characteristic to be maintained notwithstanding cutting across the width of the material.

It is believed that, depending on the dimensions of the marker, an angle between the longitudinal axis and the domain wall direction of 10° or more will provide a sufficient number of domains that do not touch the end of the magnetic element to allow the desired discontinuous characteristic to be preserved after the material is cut.

As to each of the previous examples, the two-stage process recited in the examples may be applied to a continuous alloy ribbon by first continuously transporting the continuous ribbon through the annealing region 34 shown in FIG. 2 to perform the first annealing stage (with application of the canted magnetic field), and then retransporting the ribbon through the annealing region 34 to perform the second annealing stage called for by the particular example. Alternatively, the two-stage process may be performed by continuously transporting the continuous ribbon once along a path which passes through first and second annealing regions, in which the first and second annealing stages are respectively carried out.

The following example includes a three-stage process applied to a continuous alloy ribbon.

EXAMPLE 7

A continuous amorphous alloy ribbon having a width of 1.5 mm and a thickness of about 0.02 mm, and having the composition $Co_{72.8}Fe_{4.7}Si_{5.5}B_{17}$ (atomic percent) is continuously transported through the annealing region 34 (FIG. 2) to carry out a first annealing stage at a temperature of 300° C. for an effective period of 6 minutes. During the first annealing stage a magnetic field of more than 1 kOe is applied in the plane of the alloy ribbon perpendicular to the length of the ribbon. After the first annealing stage, the alloy ribbon is taken up on reel 26 and allowed to cool.

After cooling, the alloy ribbon is again continuously transported through the annealing region 34 to perform a second annealing stage. In the second stage, three temperature zones, at 350°, 300°, and 255°, respectively, are maintained in the annealing region, and in the order stated along the ribbon transport path. The three temperature zones are of substantially equal extent along the ribbon transport path, and the total effective annealing time, taking all three zones together, is about 5 minutes. No magnetic field is applied during the second annealing stage.

The alloy ribbon is again reeled up after the second anneal, and then is once more continuously transported through the annealing region to perform a third annealing stage. For the third annealing stage, a 1 Oe magnetic field is applied along the length of the ribbon and the same three temperature zones are maintained as in the second stage. The effective annealing period in the third stage is about 10 minutes, totaling the time spent in the three temperature zones.

The continuous ribbon is then cut into rectangular segments 30 mm or 25 mm in length, and the segments are assembled with a flux concentrator at each end to form markers. The flux concentrators are 7 mm square by about 0.02 mm thick segments of iron-based amorphous alloy ribbon.

The resulting markers have a hysteresis loop characteristic similar in shape to FIG. 7, with a desirably high amplitude flux step.

If it is desired to form markers that are deactivatable and reactivatable using magnetic elements produced in accordance with the invention, this may be done by applying semi-hard or hard control segments to the magnetic elements. The resulting marker can then be deactivated by magnetizing the hard or semi-hard control segments; reactivation is accomplished by degaussing the control segments.

In the above examples, cobalt-iron based compositions with a ratio of cobalt to iron of about 15:1 (by atomic percent) were employed to provide magnetic elements exhibiting substantially zero magnetostriction. However, other ratios of cobalt and iron may be used, since zero magnetostriction, although desirable, is not essential to the invention. Further, it is believed that the techniques of the present invention can also be employed utilizing iron-cobalt-nickel, nickel-cobalt and iron-nickel based alloys of various compositions.

Figure 4:
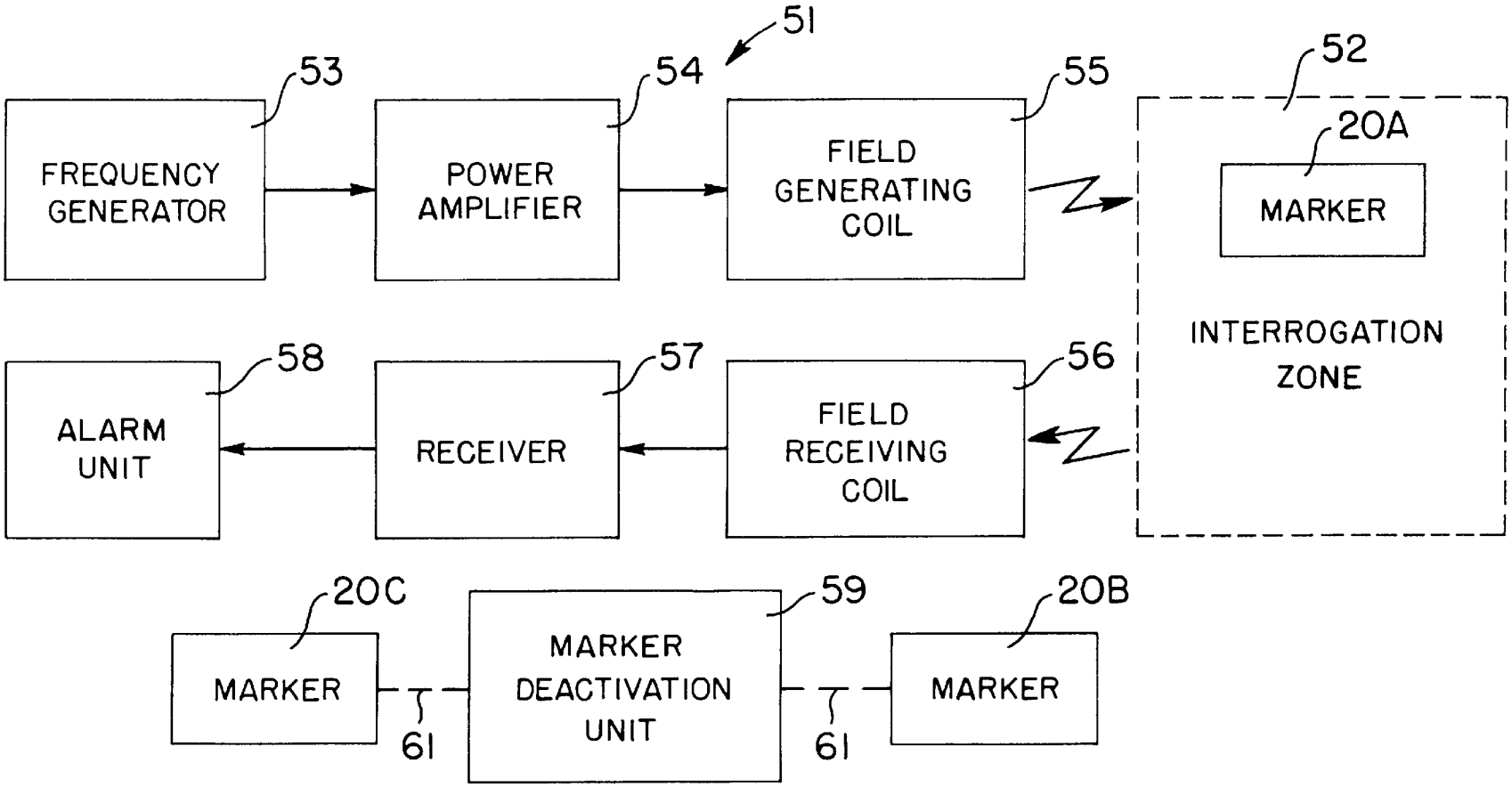
FIG. 4 illustrates an electronic article surveillance system including a deactivation unit and incorporating the marker of FIG. 1.

FIG. 4 illustrates use of the marker 20 of FIG. 1 in an article surveillance system provided with a deactivation unit. More particularly, the system 51 includes an interrogation or surveillance zone, e.g., an exit area of a store, indicated by the broken lines at 52. Marker 20A, having attributes like those of the marker 20 of the invention, is shown attached to an article in the zone 52. The transmitter portion of the system includes a frequency generator 53 whose output is fed to a power amplifier 54. The power amplifier 54, in turn, energizes a field generating coil 55. The latter coil establishes an alternating magnetic field of desired frequency and amplitude in the interrogation zone 52. The amplitude of the field will vary depending upon system parameters, such as coil size, interrogation zone size, and so forth. However, the amplitude should exceed a minimum field so that markers in the zone 52 will under all conditions experience a field above the threshold which causes a step change in magnetic flux in the marker.

The receiver portion of the system includes field receiving coils 56, the output of which is applied to a receiver 57. When the receiver 57 detects harmonic content in signals received from coils 56 in a prescribed range, generated from the marker 20A, the receiver furnishes a triggering signal to alarm unit 58 to activate the alarm.

Another marker 20B, like the marker 20 of FIG. 1, is shown on an article outside the interrogation zone 52 and therefore not subject to the interrogation field established in the zone. An authorized check-out station includes a marker deactivation unit 59. The marker 20B is deactivated by passage along path 61 through the deactivation unit 59. The passage of the marker 20B results in a deactivated marker 20C, which may now pass freely through the interrogation zone 52 without interacting with the interrogation field in a manner which triggers an alarm. It will be understood that the deactivation unit 50 generates a magnetic field with an amplitude sufficient to magnetize the control segments of the marker 20B, thereby preventing the marker 20B from exhibiting a step change in flux.

In all cases, it is to be understood that the above-described arrangements are merely illustrative of the many possible specific embodiments which represent applications of the present invention. For example, as an alternative to cutting the processed continuous alloy ribbon into rectangular segments, it is contemplated to employ a cutting angle that is not perpendicular to the length of the ribbon. Where the domain wall configuration is not perpendicular, the cutting angle may be parallel to, or at least canted in the same direction as, the wall angle, to minimize the number of domains subjected to cutting. Numerous and varied other arrangements can be readily devised in accordance with the principles of the present invention without departing from the spirit and scope of the invention.

What is claimed is:

1. A method of making a marker, the marker to be used in an article surveillance system, the method comprising the steps of:

providing a continuous ribbon of magnetic material having a longitudinal axis;

developing in said continuous ribbon of magnetic material domains having a wall configuration including a plurality of substantially parallel domain walls, said plurality of substantially parallel domain walls extending in a wall direction that is canted at least 10° from the longitudinal axis of said continuous ribbon; and after said developing step, processing said continuous ribbon to cause said wall configuration of said substantially parallel domain walls to remain in a pinned state for values of applied field below a threshold value.

2. A method according to claim 1, wherein said processing step includes annealing said continuous ribbon of magnetic material.

3. A method according to claim 2, wherein each of said developing and processing steps comprises continuously transporting said continuous ribbon of magnetic material through an annealing region.

4. A method according to claim 3, wherein said processing step includes annealing said continuous ribbon while applying a 2 Oe magnetic field along the longitudinal axis of said ribbon.

5. A method according to claim 3, wherein said processing step includes annealing said continuous ribbon while applying a 1 Oe magnetic field along the longitudinal axis of said ribbon.

6. A method according to claim 1, wherein said processing step includes depositing a layer of hard or semi-hard magnetic material on said continuous ribbon of magnetic material.

7. A method according to claim 1, further comprising the step, performed after said processing step, of cutting said continuous ribbon in a direction transverse to the longitudinal axis of said continuous ribbon to form discrete marker elements.

8. A method according to claim 1, wherein said threshold value is less than 2 Oe.

9. A method according to claim 8, wherein said threshold value is less than 1 Oe.

10. A method according to claim 1, wherein said magnetic material exhibits substantially zero magnetostriction.

11. A method of making a marker, the marker to be used in an article surveillance system, the method comprising the steps of:

providing a continuous ribbon of magnetic material having a longitudinal axis;

developing in said continuous ribbon of magnetic material domains having a wall configuration including a plurality of substantially parallel domain walls, said plurality of substantially parallel domain walls extending in a wall direction that is canted at least 10° from the longitudinal axis of said continuous ribbon;

after said developing step, processing said continuous ribbon to stabilize said wall configuration of said substantially parallel domain walls; and after said processing step, cutting said continuous ribbon in a direction transverse to the longitudinal axis of said continuous ribbon to form discrete marker elements;

said discrete marker elements each having a magnetic hysteresis loop with a large Barkhausen discontinuity such that exposing the marker element to an external magnetic field, whose field strength in the direction opposing the magnetic polarization of the marker element exceeds a predetermined threshold value, results in regenerative reversal of said magnetic polarization.

12. A method according to claim 11, wherein said processing step includes annealing said continuous ribbon of magnetic material.

13. A method according to claim 12, wherein each of said developing and processing steps comprises continuously transporting said continuous ribbon of magnetic material through an annealing region.

14. A method according to claim 13, wherein said processing step includes annealing said continuous ribbon while applying a 2 Oe magnetic field along the longitudinal axis of said ribbon.

15. A method according to claim 13, wherein said processing step includes annealing said continuous ribbon while applying a 1 Oe magnetic field along the longitudinal axis of said ribbon.

16. A method according to claim 13, wherein said developing step comprises continuously transporting said continuous ribbon of magnetic material through an annealing region on a first occasion, and said processing step comprises continuously transporting said continuous ribbon of magnetic material through an annealing region on second and third occasions.

17. A method according to claim 16, wherein, during said second and third occasions, three temperature zones having mutually different temperatures are maintained in the annealing region.

18. A method according to claim 17, wherein a 1 Oe magnetic field is applied along the longitudinal axis of said ribbon during said third occasion.

19. A method according to claim 11, wherein said processing step includes depositing a layer of hard or semi-hard magnetic material on said continuous ribbon of magnetic material.

20. A method according to claim 11, wherein said wall direction is substantially perpendicular to the longitudinal axis of said continuous ribbon.

21. A method according to claim 11, wherein said predetermined threshold value is less than 2 Oe.

22. A method according to claim 18, wherein said predetermined threshold value is less than 1 Oe.

23. A method according to claim 11, wherein said magnetic material exhibits substantially zero magnetostriction.

24. A method of making a marker, the marker to be used in an article surveillance system, the method comprising the steps of:

providing a continuous ribbon of magnetic material having a longitudinal axis;

developing in said continuous ribbon of magnetic material domains having a wall configuration including a plurality of substantially parallel domain walls, said plurality of substantially parallel domain walls extending in a wall direction that is canted at least 10° from the longitudinal axis of said continuous ribbon;

after said developing step, processing said continuous ribbon to stabilize said wall configuration of said substantially parallel domain walls; and after said processing step, cutting said continuous ribbon in a direction transverse to the longitudinal axis of said continuous ribbon to form discrete marker elements;

said discrete marker elements each having a magnetic hysteresis loop with a large Barkhausen discontinuity such that exposing the marker element to an external magnetic field, whose field strength in the direction of the magnetic polarization of the marker elements substantially exceeds a predetermined threshold level, and then reducing the field strength to a level below said threshold level, results in a step decrease in magnetization of the marker element.

25. A method according to claim 24, wherein said processing step includes annealing said continuous ribbon of magnetic material.

26. A method according to claim 25, wherein each of said developing and processing steps comprises continuously transporting said continuous ribbon of magnetic material through an annealing region.

27. A method according to claim 26, wherein said processing step includes annealing said continuous ribbon while applying a 1 Oe magnetic field along the longitudinal axis of said ribbon.

28. A method according to claim 24, wherein said wall direction is substantially perpendicular to the longitudinal axis of said continuous ribbon.

29. A method according to claim 24, wherein said predetermined threshold value is less than 1 Oe.

30. A method according to claim 24, wherein said magnetic material exhibits substantially zero magnetostriction.

31. A marker for use in an article surveillance system in which an alternating magnetic interrogation field is established in a surveillance zone and an alarm is activated when a predetermined perturbation to said field is detected, said marker comprising a magnetic element having, when not exposed to a substantial magnetic field, domains whose wall configuration is in a pinned state and remains in a pinned state for increasing magnitudes of applied field up to a threshold value at which the wall configuration is released from the pinned state causing a regenerative step change in the magnetic flux, the wall configuration of the domains returning to the pinned state upon the magnitude of applied field being decreased to a value below the threshold value;

said magnetic element having a longitudinal axis, and the wall configuration of the domains of said magnetic element including a plurality of substantially parallel domain walls, said plurality of substantially parallel domain walls extending in a wall direction that is canted at least 10° from the longitudinal axis of said magnetic element.

32. A marker according to claim 31, wherein the domains of said magnetic element have an even barber pole configuration when said magnetic element is in a substantially demagnetized condition, and the domains have an uneven barber pole configuration when the applied field exceeds said threshold value.

33. A marker according to claim 31, wherein said wall direction is canted substantially 45° from the longitudinal axis of said magnetic element.

34. A marker according to claim 31, wherein said threshold value is less than 2 Oe.

35. A marker according to claim 34, wherein said threshold value is less than 1 Oe.

36. A marker according to claim 31, wherein said magnetic element exhibits substantially zero magnetostriction.

37. A marker according to claim 31, further comprising a pair of flux concentrators each in contact with a respective end of said magnetic element.

38. A marker for use in an article surveillance system in which an alternating magnetic field is established in a surveillance region and an alarm is activated when a predetermined perturbation to said field is detected, said marker comprising a magnetic element having a magnetic hysteresis loop with a large Barkhausen discontinuity such that exposure of said magnetic element to an external magnetic field, whose field strength in the direction opposing the magnetic polarization of said magnetic element exceeds a predetermined threshold value, results in regenerative reversal of said magnetic polarization, and means for securing said magnetic element to an article to be maintained under surveillance;

said magnetic element having a longitudinal axis and domains whose wall configuration includes a plurality of substantially parallel domain walls, said plurality of substantially parallel domain walls extending in a wall direction that is canted at least 10° from the longitudinal axis of said magnetic element.

39. A marker according to claim 38, wherein said wall direction is substantially perpendicular to the longitudinal axis of said magnetic element.

40. A marker according to claim 39, wherein the domains of said magnetic element have a zig-zag configuration.

41. A marker according to claim 38, wherein the domains of said magnetic element have an even barber pole configuration when said magnetic element is in a substantially demagnetized condition corresponding to a negligible flux, and the domains have an uneven barber pole configuration when the external magnetic field has a field strength in excess of the predetermined threshold value in the direction of the longitudinal axis of the magnetic element.

42. A marker according to claim 41, wherein said wall direction is canted substantially 45° from the longitudinal axis of said magnetic element.

43. A marker according to claim 38, wherein said predetermined threshold value is less than 2 Oe.

44. A marker according to claim 43, wherein said predetermined threshold value is less than 1 Oe.

45. A marker according to claim 38, wherein said magnetic element exhibits substantially zero magnetostriction.

46. A marker according to claim 38, further comprising a pair of flux concentrators each in contact with a respective end of said magnetic element.

47. A marker for use in an article surveillance system in which an alternating magnetic field is established in a surveillance region and an alarm is activated when a predetermined perturbation to said field is detected, said marker comprising a magnetic element having a magnetic hysteresis loop with a large Barkhausen discontinuity such that exposing said magnetic element to an external magnetic field, whose field strength in the direction of the magnetic polarization of said magnetic element substantially exceeds a predetermined threshold value, and then reducing the field strength to a level below said threshold level, results in a step decrease in magnetization of the magnetic element, and means for securing said magnetic element to an article to be maintained under surveillance;

said magnetic element having a longitudinal axis and domains whose wall configuration includes a plurality of substantially parallel domain walls, said plurality of substantially parallel domain walls extending in a wall direction that is canted at least 10° from the longitudinal axis of said magnetic element.

48. A marker according to claim 47, wherein said wall direction is substantially perpendicular to the longitudinal axis of said magnetic element.

49. A marker according to claim 48, wherein the domains of said magnetic element have a zig-zag configuration.

50. A marker according to claim 47, wherein said predetermined threshold value is less than 2 Oe.

51. A marker according to claim 50, wherein said predetermined threshold value is less than 1 Oe.

52. A marker according to claim 47, wherein said magnetic element exhibits substantially zero magnetostriction.

53. A marker according to claim 47, further comprising a pair of flux concentrators each in contact with a respective end of said magnetic element.

54. A system for detecting the presence of an article in an interrogation zone comprising:

means for generating an alternating magnetic interrogation field in the interrogation zone, the magnitude of said interrogation field in said interrogation zone exceeding a threshold value;

a marker secured to an article, the marker comprising a magnetic element which has, when not exposed to a substantial magnetic field, domains whose wall configuration is in a pinned state and remains in a pinned state for increasing magnitudes of applied field up to said threshold value, and at said threshold level said wall configuration being released from the pinned state causing a regenerative step change in the magnetic flux, the wall configuration of the domains returning to the pinned state upon the magnitude of applied field being decreased to a value below the threshold value; said magnetic element having a longitudinal axis, and the wall configuration of the domains of said magnetic element including a plurality of substantially parallel domain walls, said plurality of substantially parallel domain walls extending in a wall direction that is canted at least 10° from the longitudinal axis of said magnetic element; and means for detecting perturbations to the interrogation field in said interrogation zone when said marker is present in said interrogation zone.

55. A system according to claim 54, wherein said threshold value is less than 2 Oe.

56. A system according to claim 55, wherein said threshold value is less than 1 Oe.

57. A system for detecting the presence of an article in an interrogation zone comprising:

means for generating an alternating magnetic interrogation field in the interrogation zone, the magnitude of said interrogation field in said interrogation zone exceeding a threshold value;

a marker secured to an article, the marker comprising a magnetic element having a magnetic hysteresis loop with a large Barkhausen discontinuity such that exposure of said magnetic element to an external magnetic field, whose field strength in the direction opposing the magnetic polarization of said magnetic element exceeds said threshold value, results in regenerative reversal of said magnetic polarization, and means for securing said magnetic element to an article to be maintained under surveillance; said magnetic element having a longitudinal axis and domains whose wall configuration includes a plurality of substantially parallel domain walls, said plurality of substantially parallel domain walls extending in a wall direction that is canted at least 10° from the longitudinal axis of said magnetic element; and means for detecting perturbations to the interrogation field in said interrogation zone when said marker is present in said interrogation zone.

58. A system according to claim 57, wherein said threshold value is less than 2 Oe.

59. A system according to claim 58, wherein said threshold value is less than 1 Oe.

60. A system for detecting the presence of an article in an interrogation zone comprising:

means for generating an alternating magnetic interrogation field in the interrogation zone, the magnitude of said interrogation field in said interrogation zone substantially exceeding a threshold value;

a marker secured to an article, the marker comprising a magnetic element having a magnetic hysteresis loop with a large Barkhausen discontinuity such that exposing said magnetic element to an external magnetic field, whose field strength in the direction of the magnetic polarization of said magnetic element substantially exceeds said threshold value, and then reducing the field strength to a level below said threshold level, results in a step decrease in magnetization of the magnetic element, and means for securing said magnetic element to an article to be maintained under surveillance; said magnetic element having a longitudinal axis and domains whose wall configuration includes a plurality of substantially parallel domain walls, said plurality of substantially parallel domain walls extending in a wall direction that is canted at least 10° from the longitudinal axis of said magnetic element; and means for detecting perturbations to the interrogation field in said interrogation zone when said marker is present in said interrogation zone.

61. A system according to claim 60, wherein said threshold value is less than 2 Oe.

62. A system according to claim 61, wherein said threshold value is less than 1 Oe.

* * * * *